US008350773B1

(12) United States Patent
Kindt

(10) Patent No.: US 8,350,773 B1
(45) Date of Patent: Jan. 8, 2013

(54) ULTRA-WIDEBAND ANTENNA ELEMENT AND ARRAY

(75) Inventor: Rickie W. Kindt, Arlington, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 464 days.

(21) Appl. No.: 12/792,824

(22) Filed: Jun. 3, 2010

Related U.S. Application Data

(60) Provisional application No. 61/183,618, filed on Jun. 3, 2009.

(51) Int. Cl.
*H01Q 13/10* (2006.01)

(52) U.S. Cl. ..... 343/770; 343/767

(58) Field of Classification Search ..... 343/767, 343/770

See application file for complete search history.

(56) References Cited

U.S. PATENT DOCUMENTS

| | | | | |
|---|---|---|---|---|
| 5,187,489 | A * | 2/1993 | Whelan et al. | 343/767 |
| 5,659,326 | A | 8/1997 | McWhirter et al. | |
| 6,208,308 | B1 * | 3/2001 | Lemons | 343/785 |
| 6,642,898 | B2 * | 11/2003 | Eason | 343/770 |
| 6,876,334 | B2 * | 4/2005 | Song et al. | 343/767 |
| 7,057,570 | B2 * | 6/2006 | Irion et al. | 343/770 |
| 7,277,060 | B2 * | 10/2007 | Fukuchi | 343/767 |
| 7,652,631 | B2 * | 1/2010 | McGrath | 343/767 |

OTHER PUBLICATIONS

L. Lewis, M. Fassett, and J. Hunt, "A broadband stripline array element," presented at Antennas and Propagation Society International Symposium, (1974).

P. J. Gibson, "The Vivaldi Aerial," presented at Proc. 9th European Microwave Conf., (1979).

E. W. Lucas and T. P. Fontana, "A 3-D Hybrid Finite Element/Boundary Element Method for the Unified Radiation and Scattering Analysis of General Infinite Periodic Arrays," IEEE Trans. Antennas Propag., vol. 43, No. 2, pp. 145-153, (Feb. 1995).

K. Trott, B. Cummings, R. Cavener, M. Deluca, J. Biondi, and T. Sikina, "Wideband phased array radiator," Proc. IEEE Int. Symp. on Phased Array Systems and Technology, pp. 383-386 (2003).

H. Holter, "Dual-Polarized Broadband Array Antenna With BOR-Elements, Mechanical Design and Measurements," IEEE Trans. Antennas Propag., vol. 55, No. 2, pp. 305-312 (Feb. 2007).

* cited by examiner

*Primary Examiner* — Tho G Phan

(74) *Attorney, Agent, or Firm* — Amy L. Ressing; L. George Legg

(57) ABSTRACT

An antenna element for fabricating into a linear or planar array includes a tapered slot along a main axis of the antenna element body that extends from a first slot end, defined by an outwardly flared opening at a second end of the antenna element, into a second meandering portion that is offset from the main axis, and then into a second slot end having a bend with respect to the main axis, and finally into a slot-line cavity proximate to the first end of the antenna element body. A feed port extends into the antenna element body from the outer surface of the first end of the antenna element body into the second slot end bend adjacent the slot-line cavity.

20 Claims, 7 Drawing Sheets

ULTRA-WIDEBAND ANTENNA ELEMENT AND ARRAY

CROSS-REFERENCE TO RELATED APPLICATIONS

This Application claims the benefit of U.S. Provisional Application 61/183,618 filed on Jun. 3, 2009, and incorporated herein by reference.

FIELD OF THE INVENTION

The invention relates to an antenna element and array, and more particularly, to a Vivaldi-type or flared-notch antenna and array.

BACKGROUND OF THE INVENTION

A popular antenna element for ultra-wideband antenna arrays is the Vivaldi aerial (antenna), also commonly known as the tapered-slot or flared-notch antenna. As stand-alone antennas, Vivaldi aerials can exhibit ultra-wide bandwidths of operation, where the high frequency range is typically limited by the slot-width near the feed, and low frequency is typically dictated by the width of the overall taper (must be approximately at least half a wavelength), with the overall length of the taper in the direction of end-fire radiation typically several wavelengths long. They function in a slightly different manner when condensed into an array configuration, where the mutual coupling between adjacent elements creates constructive interference to generate radiation. In an array, the element spacing is roughly half a wavelength at the highest frequency, and the low-frequency limit is set by the overall footprint of the array (comparable again to roughly half a wavelength at the low frequency). This assumes an ideal feed.

When condensed into an array configuration, another low-frequency limitation is introduced by the limited space for feed circuits. It is difficult to design ultrawideband circuits that can fit in the constricted array element cell. For this reason, it is common to find Vivaldi arrays that can achieve operational bandwidths of 3:1, 4:1, and occasionally 5:1, but seldom greater than that. Ferrite-tuned feed circuits can potentially achieve high bandwidths, but cannot be used at microwave frequencies and above (GHz range).

In its most usual form as shown in FIG. 1, a Vivaldi antenna element 10 consists of a body 12 with a tapered slot 14 along the centerline with a flared opening at one end and at the other end terminates in a slot-line open cavity 16. A strip-line or microstrip feed 18 (shown in dotted lines) terminates in a quarter-wave stub 20 necessary for enabling the strip-to-slot feed transition. The antenna 10 guides a wave from transition line impedances (~50 Ohms) to free space impedances (~377 Ohms) by gradually changing the taper of the slot 14 until the energy can simply launch from the guided slot into free space. This remarkably simple antenna concept can be used to radiate energy over nearly any range of frequencies that can be guided along the slot-line. Typically, Vivaldi elements are printed on circuit board and fed from micro-strip or strip-line feeds. This is done because it is cheap to manufacture. However, it also creates a number of limitations including stored (reactive) energy and also power-handling problems. Most antennas are fed via a coaxial cable 22. In these embodiments, the coax must transition to micro-strip or strip-line and then to slot-line, hence requiring multiple transitions/transformers that are typically band-limited in design, and therefore limit performance.

BRIEF SUMMARY OF THE INVENTION

According to the invention, an antenna element includes a tapered slot along a main axis of the antenna element body that extends from a first slot end, defined by an outwardly flared opening at a first end of the antenna element, into a second meandering portion that is offset from the main axis, and then into a second slot end having a bend with respect to the main axis, and finally into a slot-line cavity proximate to a second end of the antenna element body. A feed port extends into the antenna element body from the outer surface at the second end of the antenna element body into the second slot end bend adjacent the slot-line cavity. The feed port is configured as desired for either a coaxial feed or a strip-line feed. The invention is also directed to a linear array or a planar array of a plurality of the antenna elements.

The invention described here is an all-metal radiator with a direct coax feed, capable of handling high power. The invention provides a means of transferring energy directly from a coax or strip-line feed to a full-metal slot-line, without necessitating a quarter-wave stub, with excellent bandwidth and no soldering required.

The first advantage of the antenna element of the invention is that it achieves a higher bandwidth of operation than can usually be achieved. This makes it particularly appealing for applications that require a great deal of bandwidth, such as multi-function arrays. Because an array of this type can operate over such a large bandwidth, it is possible to use a single aperture for multiple functions/uses, rather than resorting to two or more independent arrays, as this requires greater installation space. UWB arrays become even more appealing when there is simply not the space for multiple arrays to be installed. In the prototype design, for broadside radiation, a 12:1 bandwidth is achieved (725 MHz to 8.9 GHz) with VSWR levels below 2 across the entire band. The element maintains VSWR well below 2 for scans out to 45 degrees in all scan planes over more than 8:1 bandwidth (850 MHz to 8.1 GHz). If VSWR levels of 3 are acceptable, this can be achieved from 800 MHz to 8.4 GHz, for more than 10:1 bandwidth. This operational frequency range is reported with the caveat that scanning may be somewhat restricted at the higher frequencies due to the half-wavelength element spacing of 7.4 GHz in the design shown. It is important to note that like most antenna structures, the operational frequency range changes with scaling the dimensions of the antenna.

The second advantage of the antenna element is that it is an all-metal design. Whereas most wideband Vivaldi arrays are constructed using printed circuit boards and thin metallization layers that cannot handle much power, this all-metal design is ideal for high-power applications. Though there are other all-metal designs in the literature, this design has the advantage that the antenna transitions energy directly from coax to slot-line with a direct short-circuit. The use of a single transition from coax to slot-line and the use of very wide bandwidth short-circuit transformer results in increased overall bandwidth and performance, and reduces standing waves/heating issues in the antenna feed chain.

The third advantage of the antenna element is that the feed inserts straight into the back of the element. In other prior art implementations, the elements are fed via microstrip or strip-line that must be bent or meandered to fit within available space. In a metal design, this would mean that the metallic portions of the array would have to be created form two opposing sides of metal with grooves etched into them to create circuit paths. Further, special circuits would have to be manufactured to fit into the grooves. In the present antenna element, however, a simple hole can be drilled and the coax feed directly inserted. Two coax embodiments are as follows. In a first, a hole is drilled to accommodate a bulk-head-type SMA connector (162 mil diameter) with a knurl mount. A smaller diameter hole (49 mil) is drilled to accommodate the center pin of the SMA connector. Lastly, a 203.5 mil hole is drilled to accommodate a press-fit for the outer knurl of the SMA connector. The SMA connector is then press-fit into place for a permanent connection with no soldering required. In a second, rather than drilling a hole for the center conductor, a shorter version of the SMA connector is used with a device known as a 'fuzz button'. When pressed into place, the fuzz button creates an extension of the center pin, acting as a compressed spring to give electrical contact with the far wall of the slot. Fuzz buttons are currently developed and distributed by a company called "Custom Interconnects."

In most embodiments of arrays based on this type of radiator, it is difficult to get proper electrical contact between adjacent elements as required for the constructive mutual coupling the array depends upon. Element circuits typically must be made as continuous rows and not modular. This becomes a serious issue in the dual polarized case where perpendicular rows of elements must be connected structurally, and soldering can be difficult. In this invention, the design is highly modular. The modular design makes it relatively easy to connect modules into varying sized arrays without the need for hard electrical contact, i.e. soldering or even bolting. This means the array can be assembled from modular sub-arrays that can be bolted in place without the need for conductive solder/grease/gaskets/springs, etc.

Another unique feature of this radiator is that the elements are structurally much thicker than most flared-notch radiators. This results in the advantage that there is virtually no issue with scan anomalies near the upper frequency limit of the antenna—a band limiting issue with many antennas of this type.

DETAILED DESCRIPTION OF THE INVENTION

Definition(s): As used herein, and as is well understood in the subject technical field, the term "slot" is used interchangeably with "slot-line" when describing a Vivaldi-type antenna.

Figure 1:
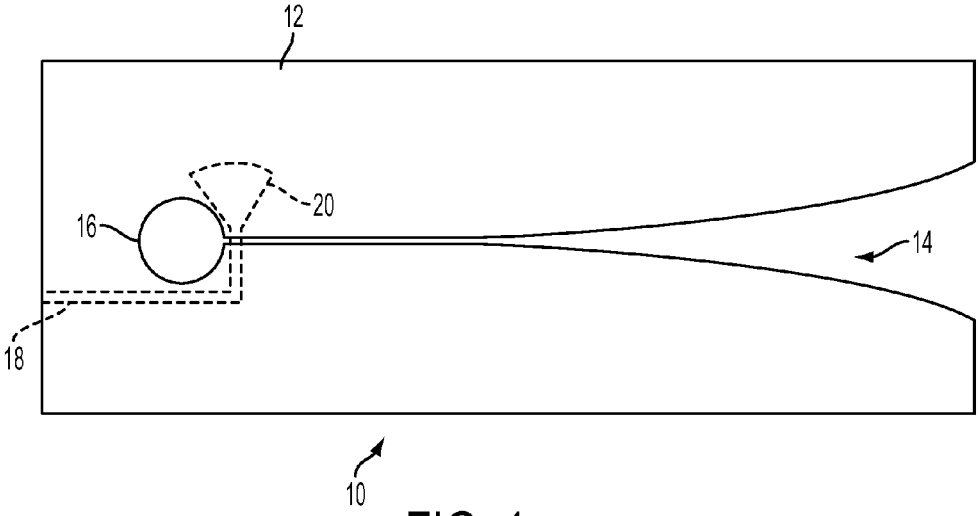
FIG. 1 PRIOR ART
FIG. 1 is a schematic illustration of the most common embodiment of a Vivaldi-type antenna (prior art)
Figure 2A:
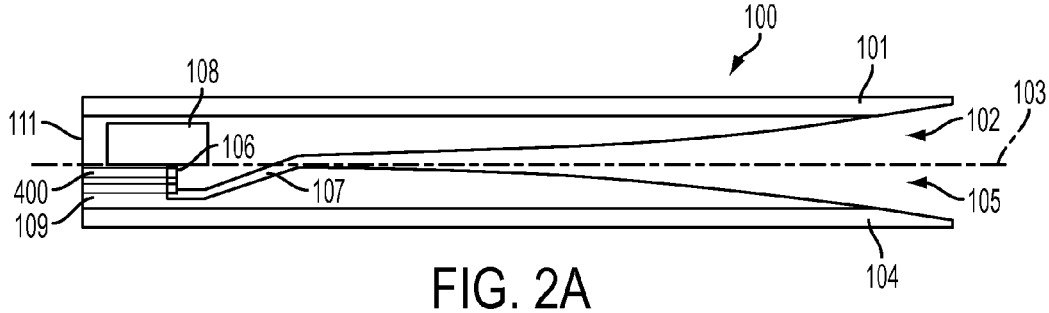
FIGS. 2A-D are schematic illustrations of an antenna element according to the invention, with FIGS. 2A-13 cross-sectional views showing a coaxial feed and strip-line feed, respectively, and FIGS. 2C-D elevation views with the interior transparent respectively showing the coaxial and strip-line feeds.
Figure 2B:
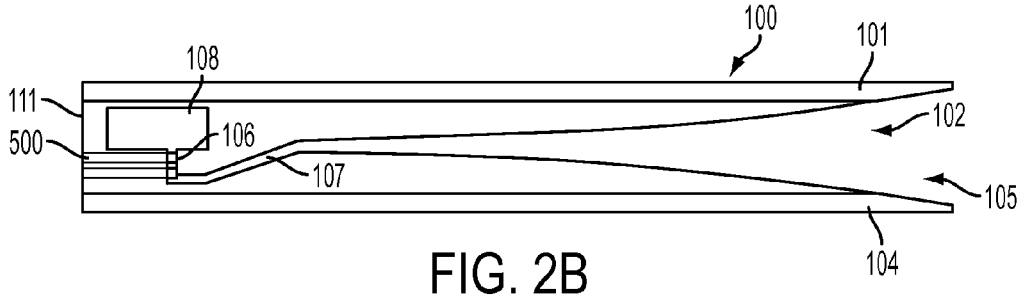
Figure 2C:
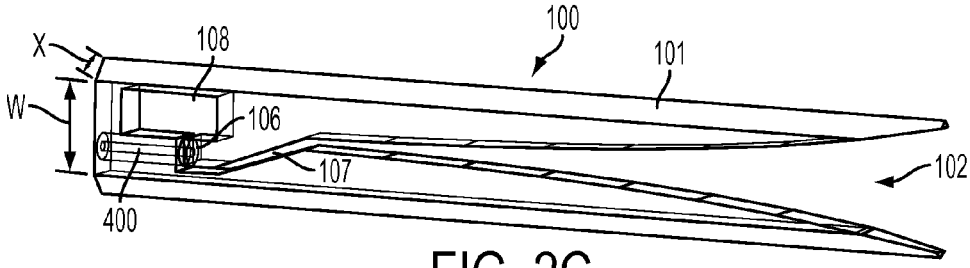
Figure 2D:
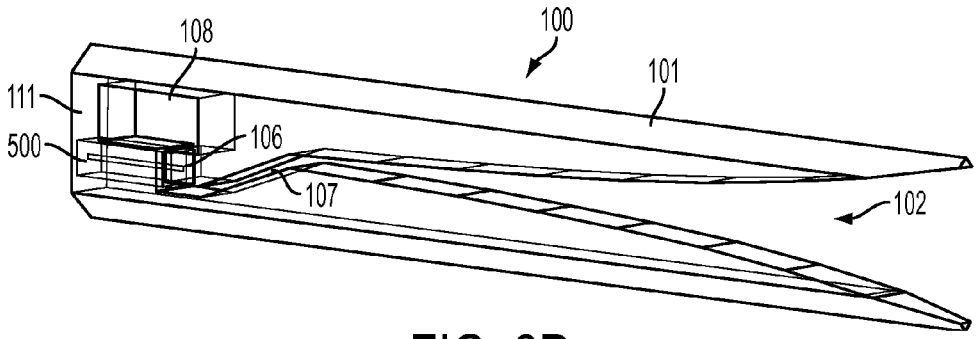

Referring now to FIGS. 2A-B, a Vivaldi-type antenna element 100 as in the invention is preferably all-metal and has a body 101 with a tapered slot 102 along a main axis 103, preferably its central axis, that at one end 104 has an outwardly flared opening 105 and that extends along axis 103 into a meandering portion 107 having an offset with respect to axis 103 and then into a second end 106 that has a sideways bend with respect to axis 103 and becomes a slot line open circuit or "open" where it terminates into a slot-line cavity 108, preferably at or near the center of the cavity 108 as shown. Cavity 108 functionally is more than merely a cavity per se, as it serves as a quarter-wave transformer that is also made larger than the slot to cause an impedance mismatch to further enhance the bandwidth of the quarter-wave effect. Element 100 also includes a feed port 109 extending from a bottom surface 111 of element 100 into slot end 106 for receiving and positioning therein an antenna feed means. FIG. 2A shows port 109 configured for receiving a coaxial ("coax") connector 400 described below in more detail, and FIG. 2B with port 109 shown with a strip-line feed 500.

Dimensionally, the element 100 is approximately 3λ long at the high end of the frequency range, preferably has a width to thickness (w:t) ratio in a range of from about 12:1 to about 2:1, and features a slot that meanders to assist with feeding. For proof of concept, two prototype arrays were built—a single polarization 32-element 100 linear array 200 shown in FIGS. 3 and 4, and a dual-polarized 8×8 planar array 300 of elements 100 shown in FIG. 5. The elements 100 preferably are constructed entirely of metal, have a thickness t of 0.25 inches, and a width w of 0.8 inches (w:t of 3.2). For conductivity and weight considerations, 6061 Aluminum was chosen as the base material for construction. The design is modular and constructed to precise tolerances so as to facilitate easy reconfiguration, assembly and disassembly. For the linear array, the circuit path of the antenna is cut from ¼"-thick Aluminum sheet stock as a continuous trace along a single axis. In the case of the 8×8 dual-polarized array, the entire structure is cut from a single block of metal. First, the square cavities created by the intersecting rows and columns of vertical and horizontal elements, respectively, are drilled and cut along the z-axis. Next, the circuit paths of the horizontal elements are cut as a continuous trace along the x-axis, followed by the vertical elements cut as a single trace along the y-axis. While the dual-polarized array shown here was cut from a single block of material, it has also been demonstrated that dual-polarized modules can be constructed from machined ¼" Aluminum sheet stock assembled in each polarization. This particular thickness (¼") was chosen because it is possible to drill a 0.162" diameter hole directly into the back of the elements, through which a bulkhead-type assembled SMA connector 400 (FIG. 6) is inserted and either pressed or bolted in place without the need for soldering. As a result, the elements are structurally much thicker than common embodiments of flared-notch designs (w:t of 3.2). The added thickness pushes undesirable modes associated with the cavities (formed by the element lattice) well-above the highest frequency of operation. In the final design, the element is roughly λ/2 wide, 5/32λ, thick, and 3λ long at the high end frequency range.

While elements 100 are preferably solid metal, elements 100 will also operate well as radiators if each element 100 has an outer surface with sufficiently high conductivity such that it radiates well. For example, a plastic body having a metalized outer surface is an alternative embodiment and provides a more lightweight construction. The plastic body may be fabricated from a plastic resin, and then electroplated, to form the outer conducting surface.

The design is implemented using SMA connectors to keep the demonstration affordable and interface with readily-available components. SMA connectors cannot be comfortably packed into less than half-inch square grid spacing. With this constraint in mind, the elements have 0.8" lattice spacing, corresponding to half-wavelength-spacing of 7.4 GHz. Though the tolerances are not critical in the linear array, in the dual-polarized design the ports are spaced just close enough that a 5/16 SMA hex nut can turn without interference from the adjacent connector of the other polarization.

Referring again to FIG. 5, the dual-polarized array 300 has elements 100 positioned in a common plane, with horizontal (x-axis) rows and vertical (y-axis) columns, and with intersecting antenna elements 100.

A flared-notch antenna works by channeling a signal from a coaxial feed line to the slot-line of the radiating flared notch. Achieving a broadband match between the feed and the radiating slot can be challenging. The simplest and preferred means to feed PCB-based designs is a microstrip-to-slot-line transition using quarter-wave stubs. More wideband options include the Marchand balun and the double-Y balun, which have been demonstrated to work over bandwidths of 5:1 or better. The main disadvantage is that these techniques require a two-step transition—from coax to microstrip/strip-line to radiating slot, which can limit bandwidth. Additionally, these circuits typically feature quarter-wave transformers which are inherently band-limiting as well.

Figure 6:
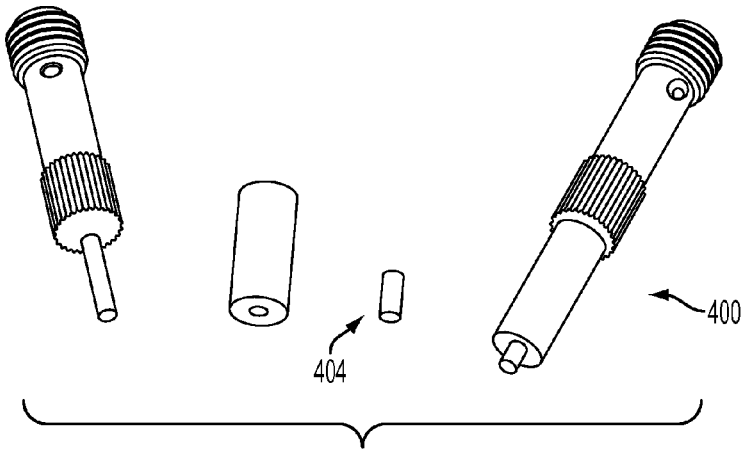
FIG. 6 shows feed line connector components and an assembled feed line connector according to the invention.
Figure 7A:
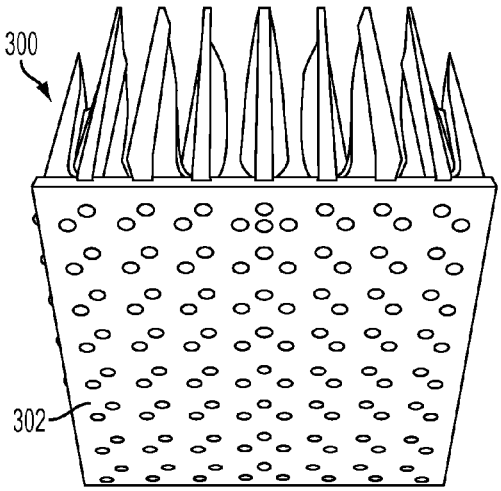
FIGS. 7A-B show the back of the dual-polarized array of FIG. 5 before (FIG. 7A) and after (FIG. 7B) the feed assemblies are embedded.
Figure 7B:
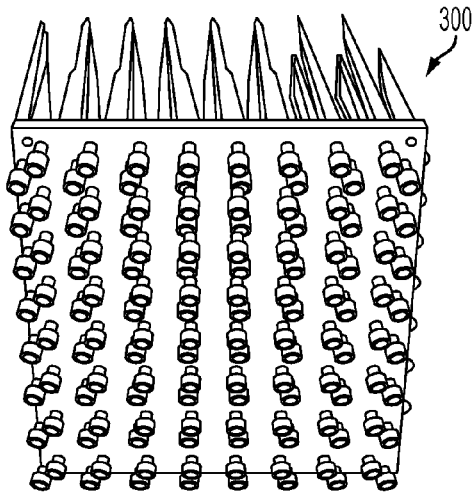

For the element presented here, a simpler feed solution is proposed. The element transfers energy directly from a coax feed to the radiating slot-line using a hard short with excellent bandwidth and no soldering required. FIG. 6 shows the design of the coaxial section of the feed port. In the implementation, a 0.162" hole is first drilled through the center of the ¼" aluminum stock such that the hole breaches the slot-line wall on the near side, as close as possible to the slot-line cavity at the base of the radiating slot (see FIG. 2). The assembled SMA feed 400 having SMA connector 402 is then inserted into the hole. The center pin contacts the far wall of the slot using a small spring-like device called a "fuzz-button" 404 (currently available from Custom Interconnects). This cylindrical device acts as an extension of the SMA center pin, retaining conductivity and shape under compression. The assembled connector is press-fit and embedded in the port hole using a knurl to hold it in place. FIG. 7 shows the base of the 8×8 array 300 before and after the connectors are embedded. From the figure, it is clear the press-fit components create a very clean design.

In order to feed the coax straight into the base of the element, it is necessary to bend the slot such that it turns 90 degrees perpendicular to the direction of radiation. In part, this is difficult to do because of the cramped space within the element cell. To compensate, the slot must be meandered as shown in FIG. 2. It has been observed that the meandering slot helps alleviate some of the loss in port isolation that occurs because of field asymmetry introduced by turning the slot 90-degrees to the direction of radiation.

To ensure EMI isolation of the electronics behind the array, a back plate 302 is used. By design, the cavity of the slot-line open is flush with the back plate 302 of the array 300. This is done because the geometry of the intersecting horizontal and vertical elements create square waveguides that can cause scan anomalies. These anomalies differ from those previously identified in the literature. Though they do not seem to cause scan blindness when the back of the array is left open, when the waveguides are closed by the back plate of the array, at certain frequencies a standing wave is created in the waveguides that is out of phase with the fields of the radiating slots. It has been identified that positioning the slot-line cavity as close to the back plate as possible moves the scan blindness to a higher frequency.

Another feature of this design is that the slot-line connects to the slot-line cavity at approximately the center of the cavity, creating symmetry in the cavity fields. As the slot-line insertion point is moved relative to the cavity center, two resonant peaks can be identified in the VSWR response. By positioning the feed point correctly, the resonances partially cancel each other, creating a single peak in VSWR that is narrower and shorter.

Figure 3:
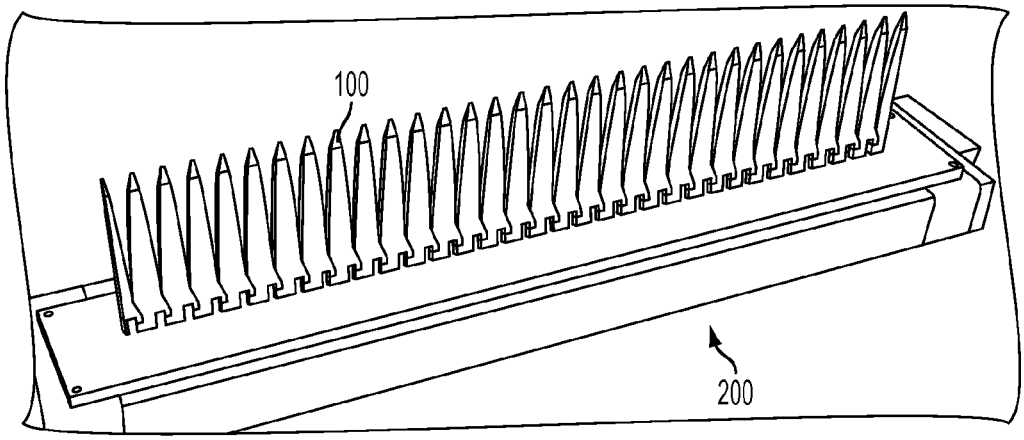
FIG. 3 is a schematic illustration of a linear array of antenna elements according to the invention.
Figure 4:
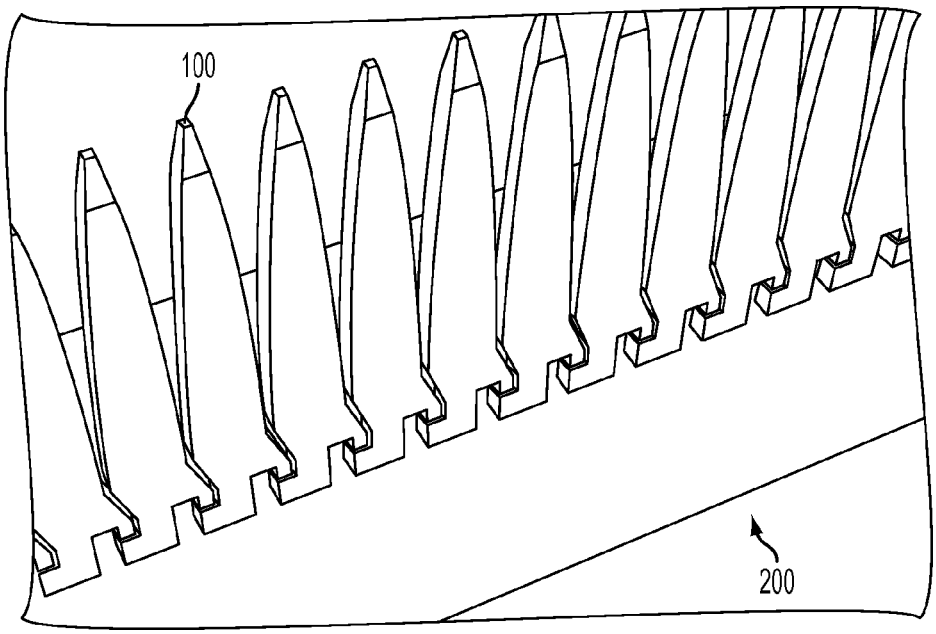
FIG. 4 is a closer up view of the linear array of FIG. 3.
Figure 5A:
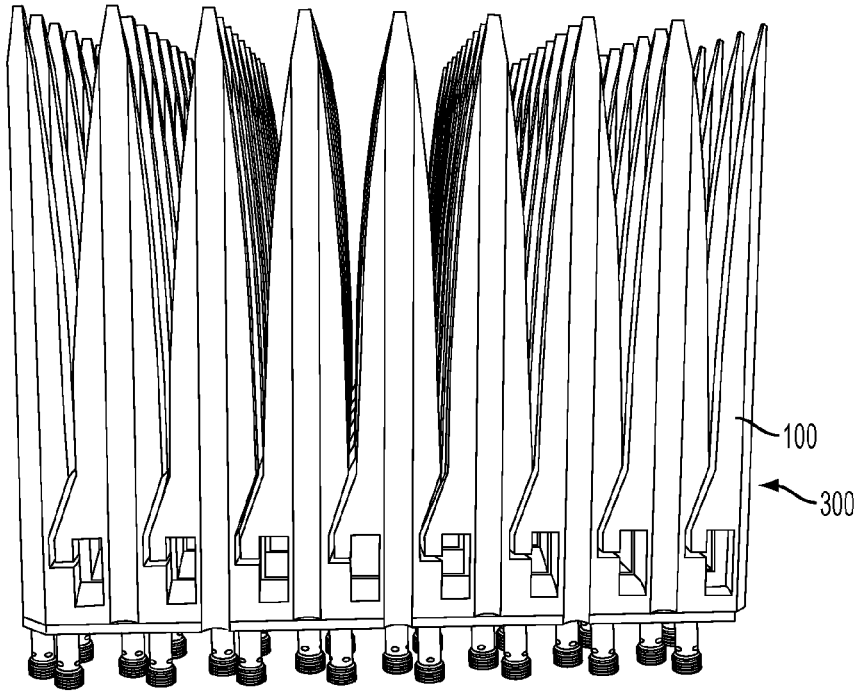
FIGS. 5A-B are side and elevation views, respectively, of a dual-polarized array of antenna elements according to the invention.
Figure 5B:
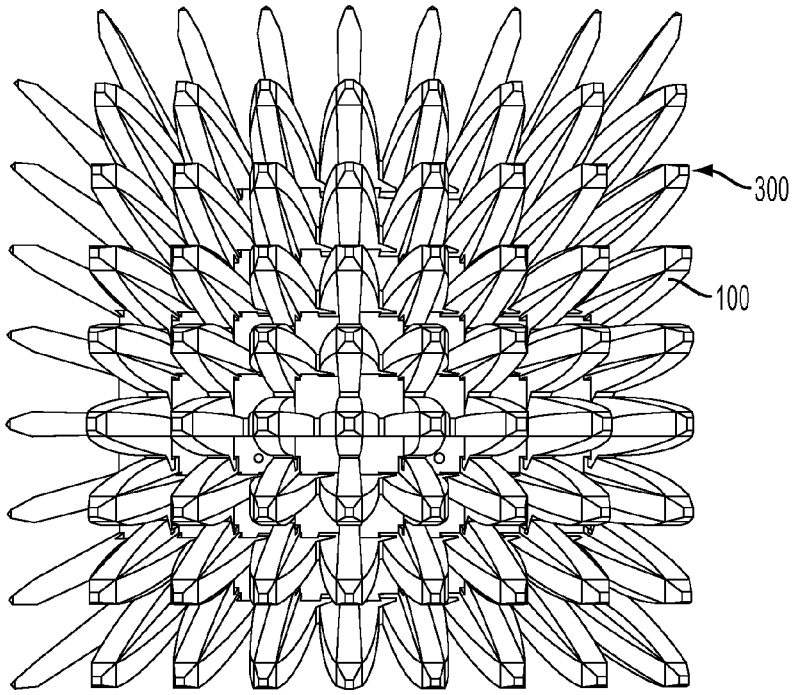

The linear array is constructed from 8-element modular sub-arrays. A 32-element linear array is formed from four sub-arrays of 8 elements and fit into a test fixture as shown in FIGS. 3 and 4. The 8×8 array of dual-polarized elements shown in FIG. 5 is a modular part of a larger array structure, but has undergone performance testing as a stand-alone array, as reported here. The reported low-end frequency performance of the 8×8 array will be relatively poor because of the small array size.

It is typically accepted that flared-notch arrays require strong coupling between adjacent elements for proper UWB functionality. It was therefore expected that some form of solder, conductive paste, gasket, or spring would be required for improved coupling at the interface between element sub-arrays. However, when tested, the elements fit together very precisely due to the high-precision manufacturing. The parts were simply bolted in place with no additional measures taken to enforce electrical contact between elements. Measurements over multiple assembly/disassembly cycles of the test structures gave very close agreement with theory without any form of additional connectivity assistance between arrays.

Results

Figure 8:
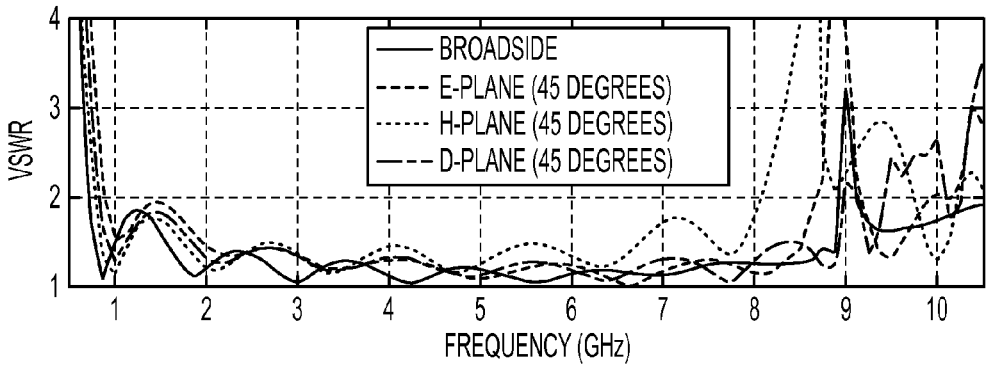
FIG. 8 shows the comparison between the synthesized impedance measurement for the $16^{th}$ (center) element of the linear array of FIGS. 4-5 to that for the infinite design case.

We first present the predicted theoretical performance of the all-metal element design based on an infinite cell (Floquet) analysis. The analysis was performed using an in-house Navy code (CEMNAV-INF) based on the Finite Element Method (FEM) and has been verified to give very similar results to commercial software. The electromagnetic CAD models for the element simulations are very accurate representations of the mechanical models used for manufacturing the array. The reference plane of the coaxial feed port used in the simulations correlates approximately with the reference plane for the network analyzer cables used to collect S-parameter measurements. FIG. 8 shows the expected VSWR of an element in an infinite planar array for broadside radiation and scans to 45 degrees in the E-plane, H-plane, and D-plane. The results shown are for the dual-polarized element pair under horizontal polarization, vertical port passively terminated. As a note, the horizontal and vertical elements are geometrically and electrically identical. At broadside radiation, a 12:1 bandwidth is achieved (725 MHz to 8.9 GHz) with VSWR levels below 2 across the entire band. The element maintains VSWR well below 2 for scans out to 45 degrees in all scan planes over more than 8:1 bandwidth (850 MHz to 8.1 GHz). If VSWR levels of 3 are acceptable, this can be achieved from 800 MHz to 8.4 GHz, for more than 10:1 bandwidth. This operational frequency range is reported with the caveat that scanning may be somewhat restricted at the higher frequencies due to the half-wavelength element spacing of 7.4 GHz. Further, the low end frequency performance will not be as good for the small array tested here. While VSWR of 2 is the baseline, for most of the operational band the actual VSWR is much lower, i.e. below 1.5, even under scan.

In this section, measurements on the arrays are presented and compared with full-wave simulations of the complete finite array structures. Here, a different type of analysis tool is used (CEMNAV-DD) based on a non-matching grid Domain Decomposition-Finite Element Method (DD-FEM). This rigorous design tool allows an engineer to predict with great accuracy exactly how each element in the array will function, giving nearly a one-to-one correspondence between numerical simulations and measurements made in the lab. For standard design procedures (using infinite array simulators) it is typically assumed that finite arrays will perform similar to the infinite design case. Truncation effects associated with finite arrays are not tested and simply treated with known techniques for improving VSWR near array edges. In the past, truncation effects were not tested because codes capable of this type of analysis didn't exist. However, now they do. Here, the use of such a tool is demonstrated in the analysis of complete UWB finite array structures, showing that simulations track very well with measurements, even under high scan angles. For the design engineer, this means that very accurate numerical studies can be performed on finite arrays prior to manufacturing, greatly increasing the chance of critical design flaws being caught early on.

Figure 9:
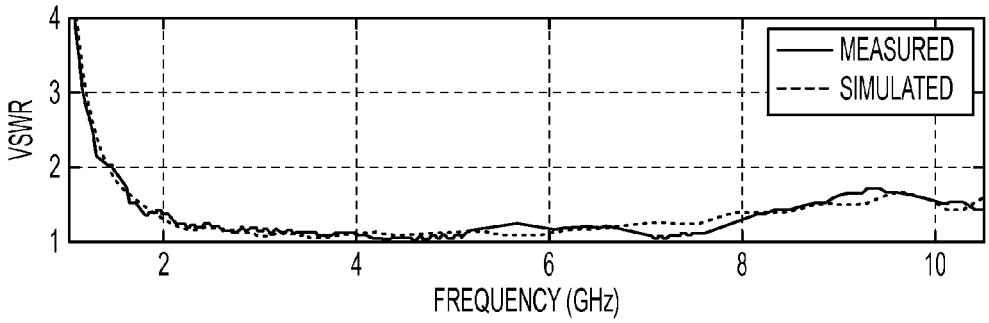
FIG. 9 shows the expected impedance performance (infinite design case) of the dual-polarized array of FIG. 6 for broadside radiation and 45-degree scans in three planes.

First, the 32-element linear array is examined. Because they are far from the array edges, elements near the center of the array are expected to perform asymptotically similar to the infinite array case. FIG. 9 shows the comparison of the measured active VSWR at element number 16 (of 32) compared to the infinite array prediction and also the exact finite array simulation (broadside radiation and uniform amplitude weighting). The agreement is very close across the entire measurement band (from 0.5 GHz to 10.5 GHz), extending above and below the intended operational range of the design (roughly 1-8 GHz). Both tools (finite and infinite) do a reasonable job of predicting the VSWR of this element.

Figure 10:
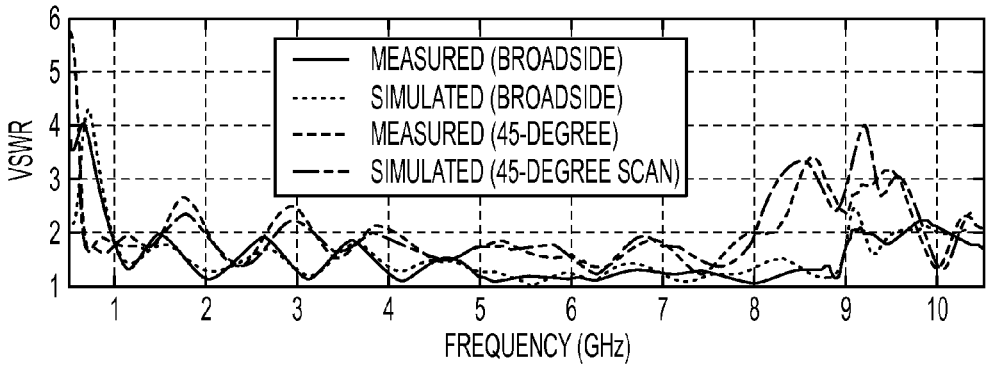
FIG. 10 shows the comparison between simulations and measurements of impedance performance for a center element of the dual-polarized array of FIG. 6 at broadside scan and 45-degrees in the E-plane.

For the 8×8 dual-polarized array, the results for element [row,col]=[3,3] are given in FIG. 10 for broadside radiation and the positive 45-degree E-plane scan case, comparing measurements to a simulation of the 8×8 array using full-wave DD-FEM analysis. As predicted, the VSWR is notably worse than the ideal results given in FIG. 8. While the VSWR is mainly below 2 across the frequency band at broadside radiation—even for this small array—it changes considerably from element to element across the row. At the higher frequencies the VSWR levels are relatively stable and somewhat comparable. For brevity, only the broadside and positive 45-degree (E-plane) scan case are reported here for element [3,3], though data has been analyzed over a range of scan angles and frequencies for all elements.

Figure 11A:
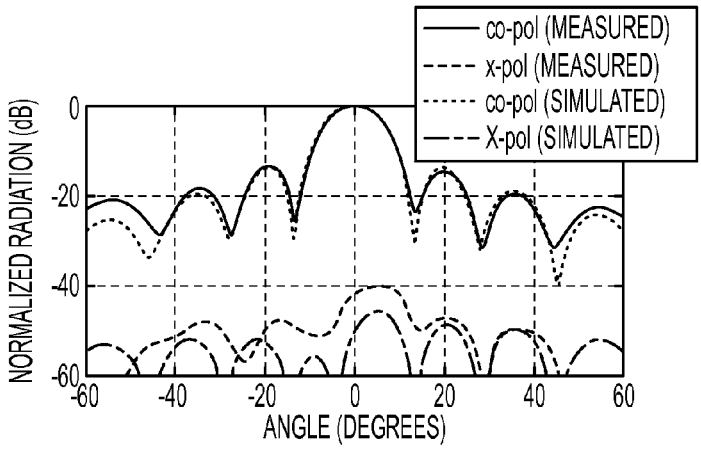
FIG. 11 shows the radiation patterns for the 32-element linear array at 2 GHz and the 8×8 dual-polarized array at 8 GHz.

FIG. 11A shows the co- and cross-polarization radiation patterns of the 32-element linear array, measured and simulated at 2 GHz. The numerical results are generated using a full-wave simulation of the entire 32-element array including the backplane, using the in-house Navy DD-FEM code. The pattern measurements are collected in a 5'×5' near-field scanner. Several variations of measurement data were collected, including synthesis of composite array patterns from the coherent addition of individual element patterns and also single array patterns formed using static power combiners. In general, the patterns are in good agreement (measured vs. simulated). The lobe structures of the beam match closely, though the simulated cross-polarization levels are somewhat better than the measured results as is typically the case comparing numerical solutions to measured data, since it is much more difficult to achieve perfect alignment/positioning in the lab.

Figure 11B:
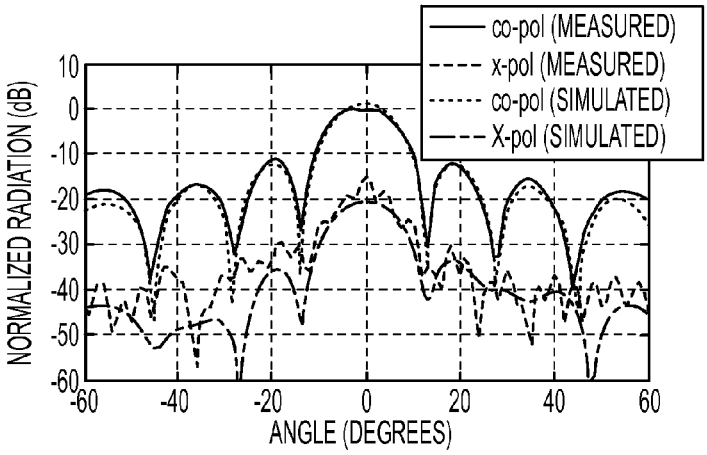

Similarly, the radiation patterns of the 8×8 planar array are presented at 8 GHz in FIG. 11B. For this case, there were not enough passive beam-forming components on hand to perform a single measurement of the full array in receive mode, as was done for the linear array. Therefore, each element was measured in receive mode, superimposing stationary element patterns of individual element patterns for each of the 64 array elements. The patterns are fairly typical, and simulations agree reasonably-well with measurements.

Figure 12:
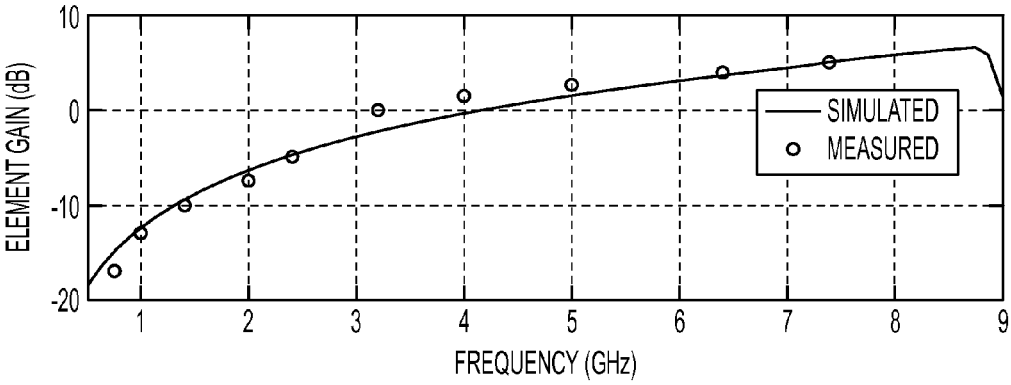
FIG. 12 shows the simulated and measured gain of the radiator across the operational frequency range.

Next, the element gain vs. frequency is given. FIG. 12 shows the gain from 0.5 GHz to 9.0 GHz. The simulated data is computed from the peak gain in the horizontal field levels at broadside, using an infinite cell computation. The measured data is computed from the element in [row,col]=[6,3] of the 8×8 array. This element was chosen because it was determined to have the best VSWR behavior in the small 8×8 array. The measured data clearly follows the theoretical trend predicted by the simulation, though some variance in the data was encountered. For the small array, it was found that the element pattern was not smooth and did not consistently give peak gain at broadside, leading to variation in the results. However, the usual gain trend is clear—approximately 5 dB of gain at half-wavelength spacing (7.4 GHz) falling off gradually towards lower frequencies.

Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. An antenna element, comprising:
an antenna body, comprising:
a first end having an outer surface;
a second end having an outwardly flared opening;
a slot-line cavity proximate to the first end;
a tapered slot along a main axis of the antenna body having a first slot end defined by the flared opening and extending into a second meandering portion that is offset from the main axis and having a second slot end having a bend with respect to the main axis terminating at the slot-line cavity; and
a feed port extending from the outer surface of the first end of the antenna body into the second slot end bend adjacent the slot-line cavity.

2. The antenna element of claim 1, wherein the antenna body is metal.

3. The antenna element of claim 2, wherein the bend of the second slot end is substantially perpendicular to the direction of radiation propagation.

4. The antenna element of claim 3, further comprising a coaxial feed connector positioned in the port so as to form a hard short at the second slot end.

5. The antenna element of claim 3, further comprising a strip-line feed element positioned in the port so as to form a hard short at the second slot end.

6. The linear antenna array of claim 3, further comprising a coaxial feed connector positioned in the port so as to form a hard short at the second slot end.

7. The linear antenna array of claim 3, further comprising a strip-line feed element positioned in the port so as to form a hard short at the second slot end.

8. The linear antenna array of claim 2, wherein the bend of the second slot end is substantially perpendicular to the direction of radiation propagation.

9. The antenna element of claim 1, wherein the slot-line cavity has a center location at which the slot-line is connected.

10. The antenna element of claim 1, wherein the main axis is the central axis.

11. The linear antenna array of claim 10, wherein each antenna body is metal.

12. The antenna element of claim 1, wherein the element has a width to thickness (w:t) ratio in a range of from about 12:1 to about 2:1.

13. The antenna element of claim 12, wherein the element has a width to thickness (w:t) ratio of about 3.2.

14. The linear antenna array of claim 12, wherein each slot-line of each element has an outward taper at the opening at each first end.

15. The linear antenna array of claim 12, wherein each slot-line cavity of each element has a center location at which each slot-line is connected.

16. The linear antenna array of claim 12, wherein the element has a width to thickness (w:t) ratio of about 3.2.

17. The linear antenna array of claim 1, wherein the main axis is the central axis.

18. The linear antenna array of claim 1, wherein the element has a width to thickness (w:t) ratio in a range of from about 12:1 to about 2:1.

19. A linear antenna array, comprising:

a plurality of antenna elements, each said element comprising:

an antenna body, comprising:

a first end having an outer surface;

a second end having an outwardly flared opening;

a slot-line cavity proximate to the first end;

a tapered slot along a main axis of the antenna body having a first slot end defined by the flared opening and extending into a second meandering portion that is offset from the main axis and having a second slot end having a bend with respect to the main axis terminating at the slot-line cavity; and a feed port extending from the outer surface of the first end of the antenna body into the second slot end adjacent the slot-line cavity, and wherein the plurality of antenna elements have a linear configuration.

20. A planar antenna array, comprising:

a plurality of antenna elements, each said element comprising:

an antenna body, comprising:

a first end having an outer surface;

a second end having an outwardly flared opening;

a slot-line cavity proximate to the second end;

a tapered slot along a main axis of the antenna body having a first slot end defined by the flared opening and extending into a second meandering portion that is offset from the centerline and having a second slot end having a bend with respect to the main axis terminating at the slot-line cavity; and a feed port extending from the outer surface of the second end of the antenna body into the second slot end adjacent the slot-line cavity, and wherein the plurality of antenna elements are positioned in a common plane with horizontal and vertical rows having intersecting antenna elements.

* * * * *